United States Patent [19]

Nye et al.

[11] 3,983,809

[45] Oct. 5, 1976

[54] BALLOON PRINTING APPARATUS HAVING INTERRUPTED DRIVE MOVEMENT

[75] Inventors: Norman H. Nye, Cuyahoga Falls; Claude V. Martin, Norwalk, both of Ohio

[73] Assignees: The Medkeff-Nye Corporation, Akron; Maple City Rubber Company, Norwalk, both of Ohio

[22] Filed: Jan. 24, 1975

[21] Appl. No.: 543,681

[52] U.S. Cl. ..... 101/38 R; 101/38 A; 198/645

[51] Int. Cl.[2] ..... B41F 17/10; B41F 17/32

[58] Field of Search ..... 101/35, 36, 37, 38 R, 101/38 A, 39, 40; 302/2 R; 198/131

[56] References Cited

UNITED STATES PATENTS

| | | | |
|---|---|---|---|
| 1,988,662 | 1/1935 | Myers | 101/36 |
| 2,645,870 | 7/1953 | Smith et al. | 101/40 X |
| 3,019,725 | 2/1962 | Freeman | 101/38 R |
| 3,224,364 | 12/1965 | Terzuoli | 101/37 |
| 3,868,899 | 3/1975 | Nye et al. | 101/35 |

*Primary Examiner*—Edgar S. Burr
*Assistant Examiner*—R. E. Suter
*Attorney, Agent, or Firm*—Oldham & Olham Co.

[57] ABSTRACT

A cylindrical printing roll is provided in combination with an endless conveyor that has a plurality of balloon carriers on the conveyor in uniformly spaced relation. Drive members connect to the conveyor for intermittent drive thereof, a printing station being provided on the conveyor course immediately adjacent the printing roll and each balloon carrier is stopped at such station, while devices for inflating a balloon on the carrier when stopped at the printing station and cylindrical rollers to press an inflated balloon at the printing station against the printing roll for printing action are also present.

8 Claims, 10 Drawing Figures

BALLOON PRINTING APPARATUS HAVING INTERRUPTED DRIVE MOVEMENT

Heretofore balloons have been printed in a number of different manners with some printing actions comprising the manual pressing of an inflated balloon against a printing member or plate. Other effects have been directed heretofore for printing an inflated balloon by more or less automatic actions and typical patents showing apparatus of this type include U.S. Pat. Nos. 2,645,870; 1,988,662 and 3,224,364. Such apparatus as proposed heretofore has functioned satisfactorily for some purposes but more positive, faster speed apparatus for use in the printing operation is necessary. Also, the areas on the balloon exposed for printing action and able to receive print thereon by the prior apparatus has been somewhat limited.

Accordingly, it is a general object of the present invention to provide a novel and improved balloon printing apparatus characterized by the fact that balloon carriers are positioned on a conveyor and an intermittent drive is provided for the conveyor, and means are provided for inflating a balloon on a carrier on the conveyor when the conveyor is stopped at an inflation and printing station.

Another object of the invention is to provide movably positioned roller means in association with a balloon printing apparatus for urging the balloons against the periphery of a cylindrical printing roller; to twist the balloons about the balloon neck which is attached to a positioning and sealing device as the printing action is obtained; and to enable relatively large peripheral areas of a balloon to be provided with printed indicia thereon by a single printing action.

Other objects of the invention are to position a balloon to extend laterally from a conveyor positioned support means for the balloon, the balloon neck being secured to the carrier, and to inflate balloons at a printing station.

Other objects of the invention are to position a plurality of guide rollers in a balloon printing machine on mounting arms for moving the guide rollers to and from operative positions engaging a balloon to force it against a cylindrical printing press; to provide a novel mandrel and associated means on a balloon carrier unit to enable a balloon positioned on the mandrel to be readily inflated, and to permit control of clamp jaws positioned on the carrier for retention of a balloon on the mandrel of the carrier and for release of the balloon; and to provide a relatively uncomplicated, sturdy apparatus for balloons printing actions.

The foregoing and other objects and advantages of the invention will be made more apparent as the specification proceeds.

Reference now is particularly directed to the accompanying drawings, wherein.

When referring to corresponding members shown in the drawings and referred to in the specification, corresponding numerals are used to facilitate comparison therebetween.

SUBJECT MATTER OF THE INVENTION

Figure 1:
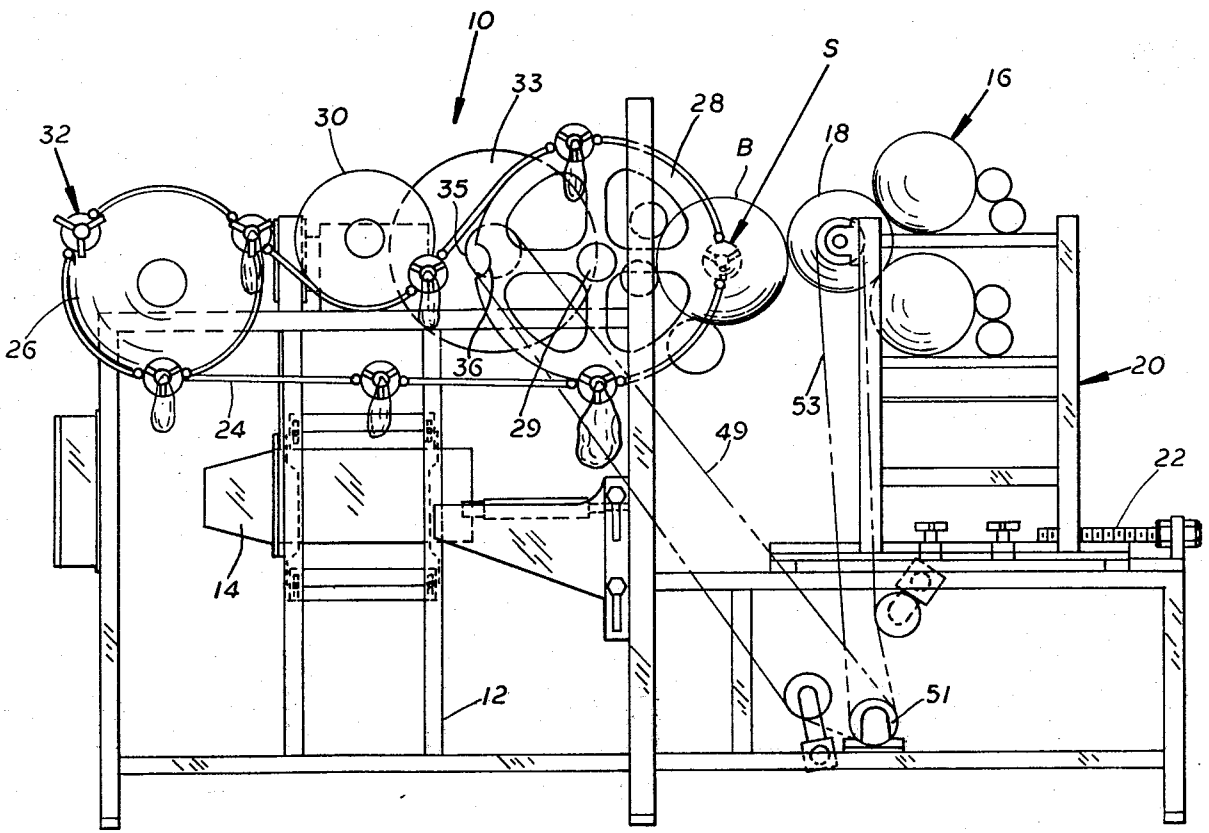
FIG. 1 is a side elevation of a balloon printing apparatus embodying the principles of the invention, but with some parts omitted for clarity.

The balloon printing apparatus of the invention, as one embodiment thereof, includes cylindrical printing means, an endless conveyor, and a plurality of balloon carriers secured to the conveyor in uniformly spaced relation to position balloons extending laterally from the conveyor in one direction, which apparatus is characterized by drive means operatively connected to the conveyor for intermittent drive thereof, the conveyor including a printing station at which the conveyor is stopped with a balloon carrier positioned at such station. Movable means are provided for inflating a balloon on the carrier when it is stopped at the printing station, such balloon being positioned with its axis parallel to the axis of the printing means and closely adjacent the periphery of the printing means; and roll means are present for engaging an inflated balloon at the printing station to force it against the printing means for printing action. Additionally, the apparatus relates to a tubular mandrel means protruding laterally from the carriers in both directions for receiving a balloon thereon at one end thereof, and an inflation means is provided and is movably positioned for engaging the other end of the mandrel for supplying air thereto to inflate a balloon on the mandrel means rapidly.

Reference now is made to the details of the apparatus shown in the accompanying drawings, and a balloon printing apparatus of the invention is indicated as a whole by the numeral 10. The apparatus includes a frame 12, a drive motor 14 and a conventional cylindrical roller printing unit 16. This printing unit or means 16 includes a printing roll 18 and with the entire printing unit 16 being mounted on a subframe 20 that is adjustably or slidably carried on an extension of the frame 12. A control rod 22 engages a portion of the subframe 20 in a conventional manner (not shown) for adjusting the position of the printing unit and subframe in relation to the remainder of the apparatus and balloons positioned thereby. Any desired adjustment may be made to position the subframe and printing unit in proper printing relation to the remainder of the apparatus for the balloon size being processed. Any suitable roller type printing apparatus can be used.

The apparatus 10 also includes an endless conveyor 24, shown to be of the chain type, and which chain conveyor engages a positioning sprocket 26 and a drive sprocket 28 to be moved through a fixed course thereby. A guide sprocket 30 is present in the apparatus. All of such sprockets 26, 28 and 30 are suitably journalled on the frame 12 and drive is provided thereto as hereinafter described.

The conveyor 24 has a plurality of individual balloon carrier means or members 32 secured to longitudinally uniformly spaced portions of the conveyor. These balloon carriers are adapted to position a balloon on one end of a mandrel means 34 provided on each balloon carrier and protruding laterally therefrom in both directions. These balloon carriers are larger than ordinary portions of the chain conveyor 24 and hence the sprockets engaging the conveyor are recessed as at 36 to receive a balloon carrier in such recess as the conveyor progresses around the various sprockets for movement through a fixed course. The carrier means 32 engage the conveyor 24 by bolts 31 or the like.

Figure 5:
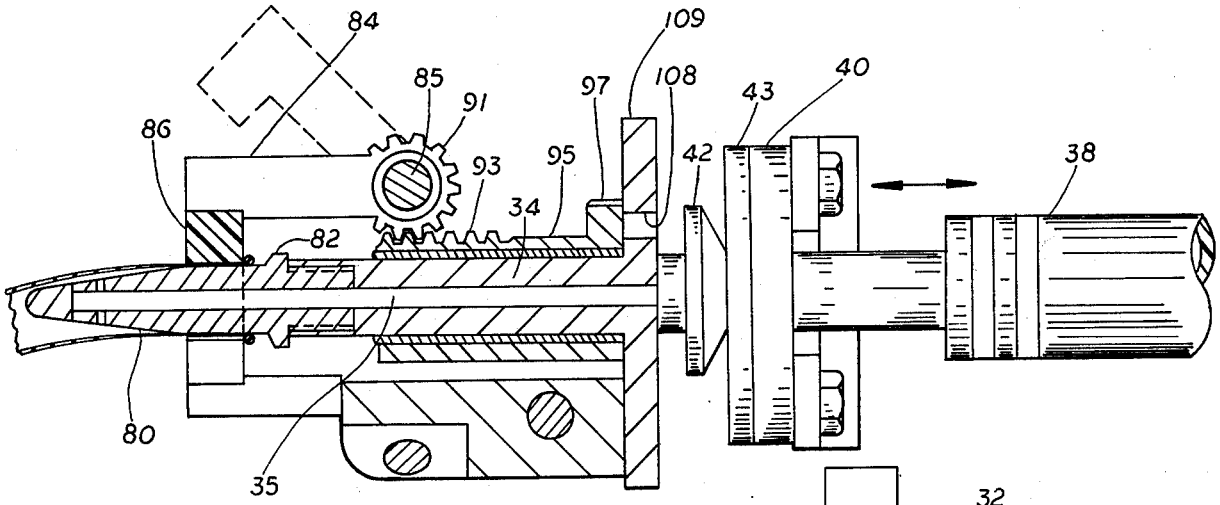
FIG. 5 is a longitudinal section through a balloon carrier and showing in elevation a balloon inflation hose engaging the carrier.

Intermittent drive for the conveyor 24 is obtained by a conventional geneva drive unit provided by a disc 33 on a main drive shaft 35 and connected to the motor 14. Such disc has drive pins that operatively and individually engage four radially extending, equally circumferentially spaced slots 37 in a plate 39, FIG. 10, secured to the drive shaft 29 of the drive sprocket 28 for the conveyor whereby intermittent movement of the conveyor results. The drive means is set up so as to be adapted to stop each of the balloon carriers 32 at a printing station indicated at S in FIG. 1 of the drawings. At such printing station, as indicated in FIG. 5 of the drawings, a compressed air supply means, comprising a flexible tube 38 having a discharge head 40 there on is brought up into engagement with a head 42 on the mandrel means. Such head 42 is of complementary shape to a conical recess provided in a surface sealing disc 43 on the head 40 whereby compressed air from the tube 38 will flow rapidly under sealed conditions into a bore 35 of the mandrel means 34. This will rapidly inflate a balloon positioned on the opposite end of such mandrel means and retained thereon by jaw members on the balloon carriers 32.

Suitable control means (not shown) are provided in the apparatus of the invention for supply of air to the tube 38 from a source (not shown) connected thereto when the conveyor 24 is stopped and the tube 38 is moved to engage the positioned balloon carrier.

Any desired type of adjustable speed means and speed reducers are provided in the drive system for the conveyor 24. All components of the apparatus are tied to a unitary drive control means, including the printing unit 16. A chain belt drive 49 extends from the drive shaft 35 to a shaft 51 on the frame 12 from which a second drive chain 53 connects to transmit drive to the various rolls in the printing unit 16 all of which are driven in relation to each other in a conventional manner.

Figure 2:
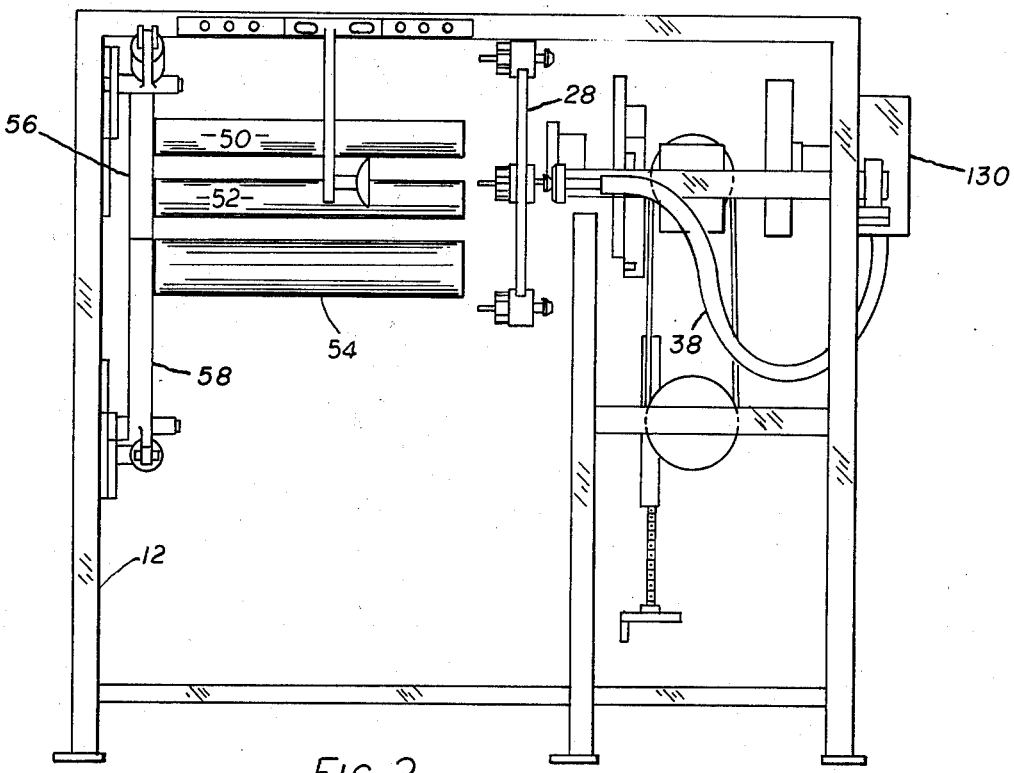
FIG. 2 is a right side elevation of the apparatus of FIG. 1 with the printing means being omitted.
Figure 3:
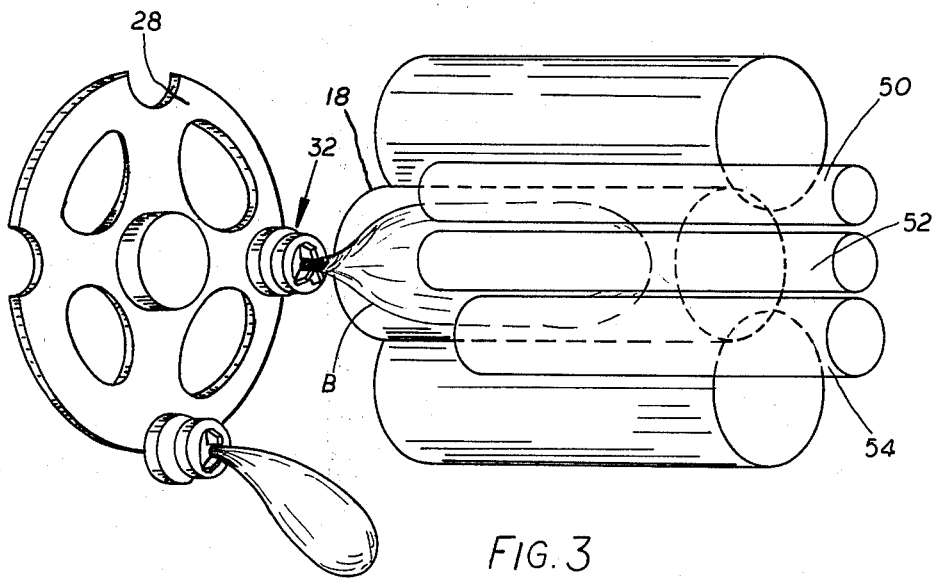
FIG. 3 is a perspective view, somewhat diagrammatically shown, of a balloon being positioned for and guided against a rotary printing means for printing action.
Figure 10:
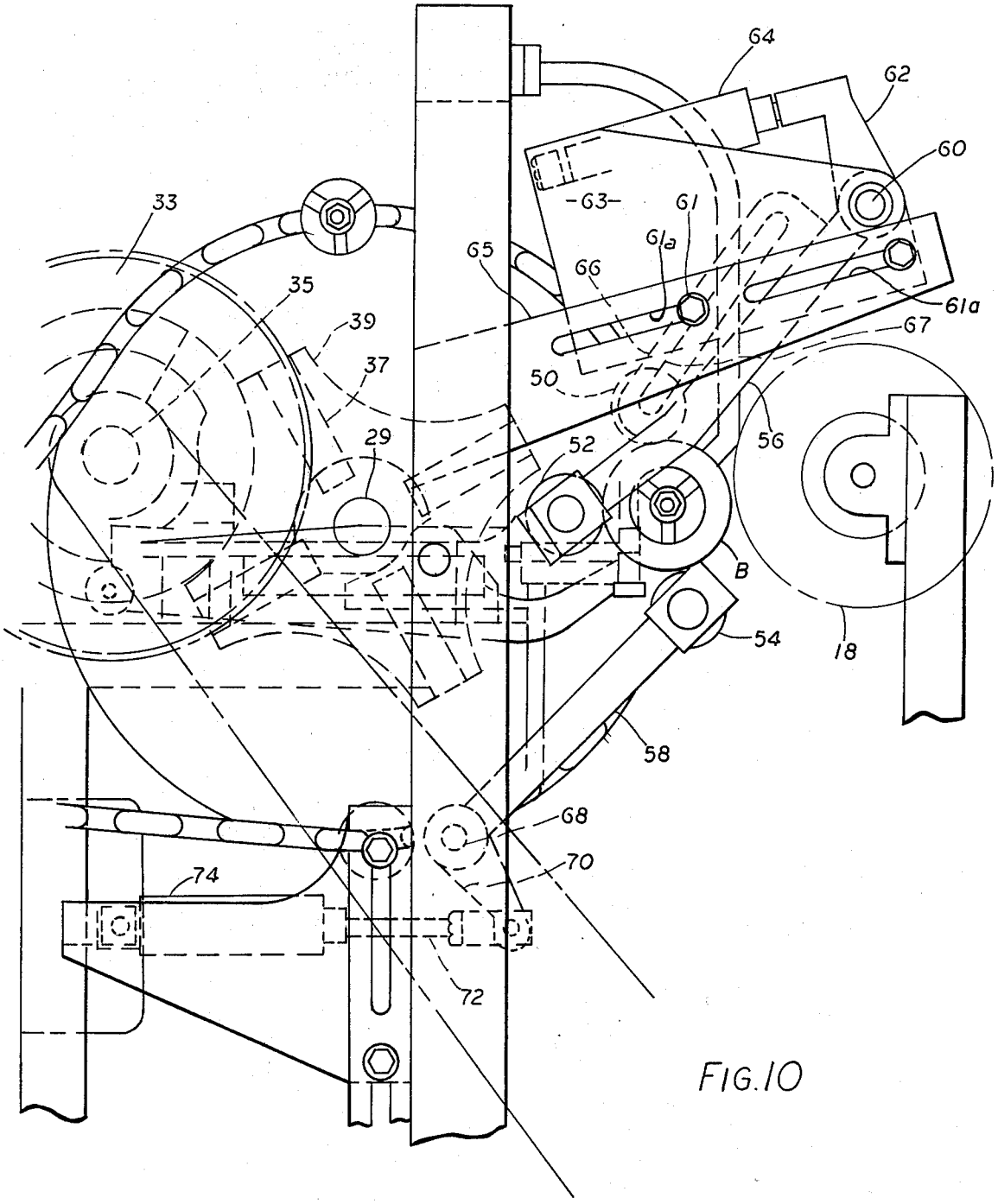
FIG. 10 is an enlarged detail side elevation of the drive and roll support means.

As another feature of the present invention, means are provided to aid in forcing the balloon against the printing roll, or cylinder 18, for effective printing action over a relatively long circumferentially extending arc. Thus, FIGS. 2, 3 and 10 show a plurality of rolls 50, 52 and 54 that are positioned with their longitudinal axes parallel and with the rolls 50 and 52 being operatively mounted on one carrier arm 56 and the roll 54 is positioned on a second carrier arm 58. The apparatus of the invention is especially adapted for printing elongate cylindrical balloons, and the rolls 50, 52 and 54 engage spaced peripheral portions of the balloons, when inflated, to press the balloon against the printing roll.

The arm 56 is journalled on a shaft 60, FIGS. 10, that has a control arm 62 secured thereto and extending therefrom for controlling the arcuate position of the shaft 60 and hence the position of the carrier arm 56. Such control arm 62 operatively engages a power means, such as a cylinder 64 operatively positioned on a bracket 63 carried on and slidable longitudinally of an arm 65 fixedly secured to the frame 12. Thus, when desired, the cylinder 64 is actuated to move the free end of the carrier arm 56 down to position the roll 52 on the end thereof in operative engagement with a portion of the periphery of a balloon being printed. The bracket 63 is adjustable on the arm 65 by means of securing screws 61 extending through slots 61*a* in the arm 65. The shaft 60 is journalled on the bracket 63. The second roll 50 is adjustably and operably associated with the bracket 63 and extends downwardly therefrom on the arm 66. The roll 50 is adjustable in a slot 67 in the arm 66 and held in spaced but parallel relationship to the roll 52 for engaging a different peripheral portion of the balloon to aid in pressing the balloon tightly against the printing cylinder.

The third control roll 54 engages yet a third peripherally spaced portion of a balloon being printed, and such roll, and its carrier arm 58 are operatively positioned on the frame 12. The carrier arm 58 engages a positioning shaft 68, journalled on the frame, that has a control arm 70 extending therefrom and fixedly secured thereto. Such control arm 70 in turn is engaged by a piston rod 72 operated by a cylinder 74 so that actuation of the cylinder 74 will cause oscillation of the control arm 70 which will move the shaft 68 arcuately and bring the roll 54 from a down inoperative position up to engage a lower portion of a balloon being processed to aid in forcing it against the periphery of the printing roller.

The drawings clearly show that the rolls 50, 52 and 54 will engage three peripherally spaced portions of the inflated balloon and by controlling and adjusting the positions of these rolls in relation to one of the balloon carriers 32 at the printing station S, a light backup action can be provided for the inflated balloons B during the printing action. FIG. 3 indicates that the rolls can be pressing the balloon against the printing cylinder 18 so that when the cylinder rotates, then the balloon will be twisted around its neck that is secured to the balloon carrier 32. Such twisting of the balloon occurs, obviously, after the balloon has been inflated and this gives a relatively long circumferential portion of the periphery of the balloon available to be pressed against the cylinder to have printing applied thereto.

Figure 6:
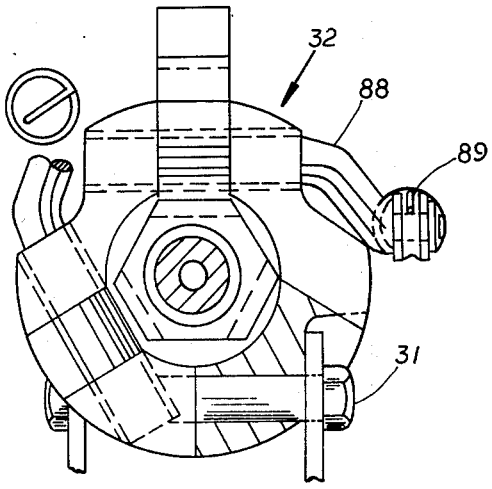
FIG. 6 is a vertical section taken at the exposed end of the mandrel of FIG. 5.
Figure 7:
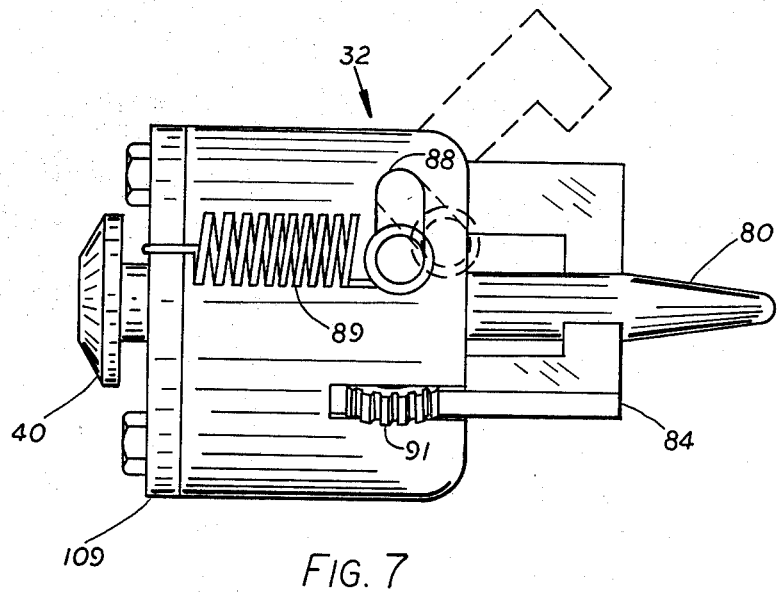
FIG. 7 is a side elevation of a balloon carrier.
Figure 8:
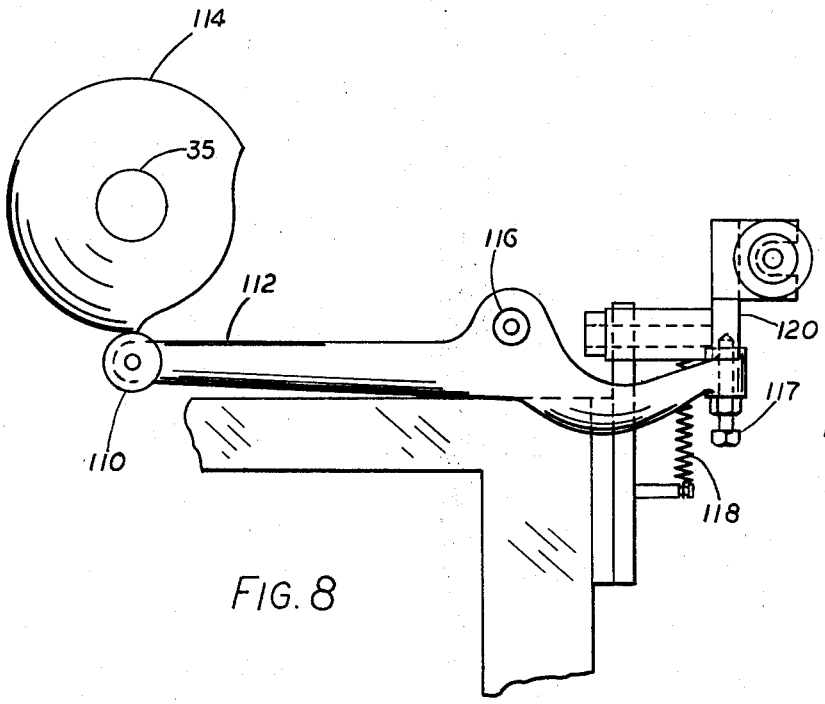
FIG. 8 is a detail elevation of the control for the air supply member with other parts omitted for clarity.
Figure 9:
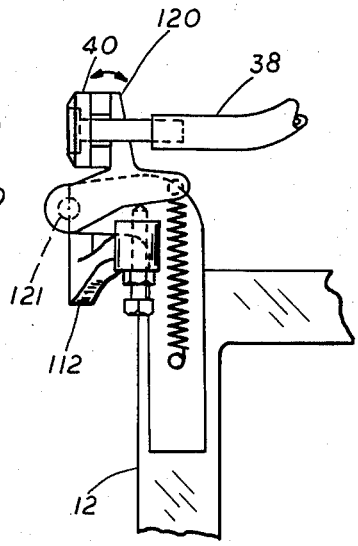
FIG. 9 is a right side elevation of the apparatus of FIG. 8.

FIGS. 5 and 6 of the drawings best show the details of the mandrel means and balloon positioning member of the apparatus. The mandrel means 34 has one end of its bore 35 operatively connecting to the head 42 while a balloon positioning section 80 is provided on the other end of the mandrel means. The section 80 protrudes laterally from the frame of the balloon carrier 32. Normally, an operator manually places a balloon with its neck in good operative engagement with the mandrel 80 and extending up to a shoulder 82 formed thereon. The carrier 32 has a plurality of jaws or securing arms 84 pivotally carried thereby. These jaws have an operative position wherein the jaws are in resilient engagement with the mandrel 80 and operatively engage and retain a balloon thereon by plastic pads 86 on the ends of the jaws and suitably secured thereto. Normally three of these jaws 84 are provided in equally circumferentially spaced recessed portions of the periphery of the frame of the balloon carrier and they extend axially thereof, the axis of the balloon carriers being positioned normal to the chain conveyor by which they are positioned. These jaws or securing arms 84 are supported by and journalled on the frame of the balloon carriers by shafts 85 having a crank section 88 extending from a protruding end of each shaft 85. The crank end or section 88 and sack jaw 84 is resiliently urged at all times into an operative position by springs 89 operatively extending between the crank section 88 and the frame of the balloon carrier. The securing arms have gear segments 91 thereon engaging rack gears 93 formed on and extending axially of a sleeve 95 slidably positioned in the balloon carrier to control the positions of the securing arms 84.

Figure 4:
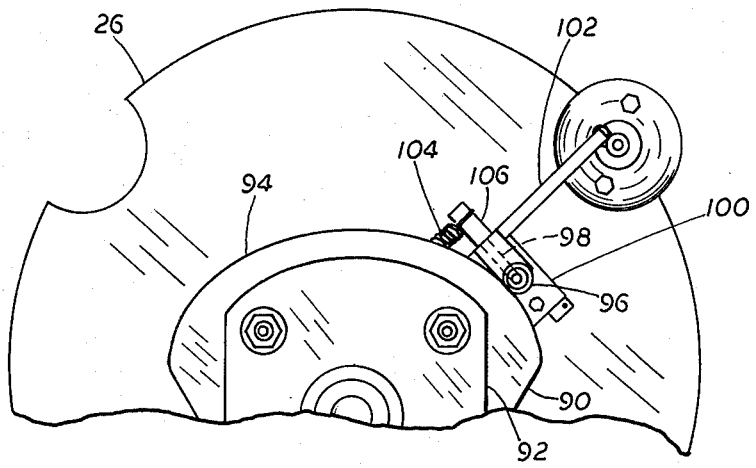
FIG. 4 is a fragmentary elevation of the control means for the clamp jaws on the balloon carrier means.

For balloon release, FIG. 4 shows a cam 90 carried by a bracket 92 secured to the frame adjacent the sprocket 26. The cam has a control surface 94 concentric with the sprocket 26. Such sprocket carries a release means adjacent each circumferentially spaced area thereof adapted to engage a balloon carrier as the conveyor 24 is moved through its fixed course. Such release means includes a cam follower 96 on an arm extending from a shaft 98 journalled in a bearing block 100 secured to the sprocket 26. The shaft 98 has a generally C-shaped extension arm 102 secured thereto and extending therefrom toward the sprocket 26. A spring 104 has one end that engages a pin 106 extending from the arm 102 at right angles to the cam follower axis and the other end of such spring engages the bearing block or sprocket to bias the arm 102 away from the sprocket. However, the cam 90 causes the shaft 98 to rotate in a direction to move the extension arm 102 toward the sprocket 26 and force the end of the arm through a hole 108 in an end plate 109 of each balloon carrier. The sleeve 95 on which the rack gears are formed has an end flange 97 engaged by the arm 102 to force the sleeve axially. This moves the clamp arms 84 to a release position so a balloon can be removed from the mandrel and a second balloon be applied thereto when the balloon carrier is moving around the sprocket 26.

The movement of the air supply tube 38 to and from engagement with the mandrel member of a balloon positioning unit only needs be about approximately ⅛ inch in length. The head 40 on the air supply unit has the resilient sealing member 43 on its front face and only about ⅛ inch penetration by the conical head 42 of the mandrel into engagement with the air discharge member is required. Such control movement can be provided in any desired manner but preferably it operates from the primary power supply shaft and associated means. Thus, a cam follower 110 is positioned on a support arm 112 for engaging a cam plate 114 that is on the main drive shaft 35. Such arm 112 is journalled on a support 116 on the frame and a set screw 117 is adjustably positioned on the arm 112 to engage a further pivotally positioned support 120. Such support 120 carries the head 40 for moving it on an arc to move the air supply means 38 into operative engagement with the mandrel head 42 on the balloon carrier assembly. A spring 118 engages the bracket 120 to urge the head 40 normally to inoperative position and the cam follower 110 moves the head or connector 40 to connect to the mandrel head 42. The support or bracket 120 is positioned on a pin 121 mounted on the frame 12.

The springs 89 bias the securing arms 84 to operative balloon retaining positions at all times except when the conveyor 24 is moving around the sprocket 26. Then for the operative length of the cam 90, the arms 84 are moved to released positions for an operator to remove a deflated printed balloon and put another balloon B on the mandrel 80.

The cylinders 64 and 74 that move the rolls 52, 54 and 56 to engage spaced peripheral portions of an inflated balloon are actuated by conventional control means only after the balloon at the printing station has been inflated, and they are then returned immediately to inoperative positions when the print action is completed. The rolls are suitably rotatedly positioned.

The apparatus is controlled from a control box 130, having conventional controls therein, and the air hose 38 connects thereto. Other air supply hoses (not shown) connect the box 130 to the double acting cylinders 64 and 74 for timed actuation thereof. Power and an air supply means connect to the box 130 for control thereby.

From the foregoing, it will be seen that an automatic printing action can be obtained on balloons and that the objects of the invention have been achieved.

While one complete embodiment of the invention has been disclosed herein, it will be appreciated that modification of this particular embodiment of the invention may be resorted to without departure from the scope of the invention.

What is claimed is:

1. In a balloon printing apparatus, a printing means including a cylindrical roll for applying a printed impression on an article contacting the same, the combination of an endless conveyor movable along a fixed course that defines a plane, a plurality of individual balloon carriers secured to said conveyor in uniformly spaced relation to position any balloons positioned thereon extending from said conveyor in one direction and comprising drive means operatively connected to said conveyor for intermittent drive thereof, said conveyor course including a printing station at which said conveyor is stopped when any one of said balloon carriers reaches such station, said printing station being adjacent said printing means, a balloon having a center axis on said one of said balloon carriers, means for inflating the balloon on said one of said balloon carriers when it is stopped at said printing station, the inflated balloon being positioned with its center axis parallel to the longitudinal axis of said cylindrical roll and with the balloon being positioned closely adjacent the surface of said cylindrical roll, roller guide means opposed and parallel to said cylindrical roll for engaging the inflated balloon at said printing station to hold it against said cylindrical roll for printing action, and support members for said roller guide means to move the same to and from operative engagement with the inflated balloon.

2. In a balloon printing apparatus as in claim 1 where said balloon carriers each include a tubular mandrel means, for supporting a balloon, having two ends each of which protrudes from its said balloon carrier; said mandrel means having one said end for receiving a balloon thereon; jaw means to engage and retain the balloon on said mandrel means; a movably positioned inflation member adjacent the other said end of said mandrel means to supply air thereto for inflating the balloon on said mandrel means; and control means engaging said inflation member to bring it into operative engagement with said mandrel means.

3. In a balloon printing apparatus as in claim 1 where said roller guide means comprise at least a pair of cylindrical guide rolls having longitudinal axes parallel to the axis of said cylindrical roll, and said support members include positioning arms for said pair of cylindrical guide rolls and power means for said positioning arms to move said cylindrical guide rolls to and from operatively engaging the inflated balloon at said printing station to force any size balloon against said first named cylindrical roll.

4. In a balloon printing apparatus as in claim 3 where three of said cylindrical guide rolls are provided, said positioning arms engage said guide rolls to bring such rolls to vertically spaced positions for engaging spaced peripheral portions of the inflated balloon, said balloon having a neck portion attached to said one of said balloon carriers, said guide rolls rotating the balloon about the neck portion thereof as the printing action is being affected.

5. In a balloon printing apparatus as in claim 2 including a balloon attaching and detaching station at a portion of said conveyor course remote from said printing station, and fixedly positioned cam actuated control means operatively engaging said jaw means to move the same from a balloon engaged to a release position at said attaching and detaching station when said conveyor moves a said balloon carrier to such station.

6. In a balloon printing apparatus, a printing means including a cylindrical roll for applying printing onto an inflated balloon pressed thereagainst, the combination of an endless conveyor positioned for rotation through a fixed course lying in and defining a plane, a plurality of balloon carriers secured to said conveyor in uniformly spaced relation to position balloons extending laterally from said plane of said conveyor in one direction and comprising drive means for said conveyor including a drive shaft operatively connected to said conveyor for intermittent drive of said conveyor, said conveyor course including a printing station at which said conveyor is stopped when any one of said balloon carriers reaches such station, said printing station being adjacent said printing means, said balloon carriers each having a balloon positioning mandrel secured thereon, a balloon having a center axis having been positioned on the balloon positioning mandrel of said balloon carrier upstream of said printing station, means for inflating the balloon on a said balloon carrier when stopped at said printing station, the inflated balloon being positioned with its center axis parallel to the axis of said cylindrical roll and with the balloon being positioned closely adjacent the periphery of said cylindrical roll, and said balloon inflating means including an air supply tube, means positioning said air supply tube for movement to and from operative engagement with said balloon positioning mandrel to supply air to the balloon thereon, a cam member on said drive shaft, and control means connecting said cam member to said positioning means to engage said air supply tube with said balloon mandrel when drive of said conveyor is interrupted.

7. In a balloon printing apparatus as in claim 6, a plurality of roller guide means for engaging the inflated balloon to press it against said cylindrical roll, and timed controls for said roller guide means to move them into engagement with the inflated balloon in correlation to drive of said conveyor.

8. In a balloon printing apparatus as in claim 7, where the balloons are of cylindrical shape when inflated, and said roller guide means are elongated cylindrical rollers to engage peripherally spaced portions of the inflated cylindrical balloon to press it against said cylindrical roll.

* * * * *

UNITED STATES PATENT OFFICE

CERTIFICATE OF CORRECTION

Patent No. 3,983,809 Dated October 5, 1976

Inventor(s) Norman H. Nye and Claude V. Martin

It is certified that error appears in the above-identified patent and that said Letters Patent are hereby corrected as shown below:

Column 1, line 52, "balloons" should be -- balloon --

Column 4, line 1, "Figs." should be -- Fig. --

Column 5, line 9, "sack" should be -- each --

Signed and Sealed this

Fourteenth Day of December 1976

[SEAL]

*Attest:*

RUTH C. MASON
*Attesting Officer*

C. MARSHALL DANN
*Commissioner of Patents and Trademarks*